United States Patent [19]

Ahorner

[11] Patent Number: 5,051,170

[45] Date of Patent: Sep. 24, 1991

[54] TWO FRAME ELASTIC SCREENING APPARTAUS HAVING SUBSTANTIALLY LINEAR RELATIVE MOVEMENT

[75] Inventor: Leander Ahorner, Waidhofen a.d. Ybbs, Austria

[73] Assignee: IFE Industrie- Einrichtungen Fertigungs Aktiengesellschaft, Waidhofen, Austria

[21] Appl. No.: 403,998

[22] Filed: Sep. 5, 1989

[30] Foreign Application Priority Data

Sep. 5, 1988 [AT] Austria ..... A 2178/88

[51] Int. Cl.[5] ..... B07B 1/30; B07B 1/42; B07B 1/49

[52] U.S. Cl. ..... 209/310; 209/341; 209/365.1; 209/367

[58] Field of Search ..... 209/310, 315, 319, 325, 209/341, 344, 365.1, 365.3, 367, 409, 412, 415, 326, 329, 366, 366.5

[56] References Cited

U.S. PATENT DOCUMENTS

| | | | |
|---|---|---|---|
| 3,378,142 | 4/1968 | Wehner | 209/325 |
| 3,647,068 | 3/1972 | Wehner | 209/310 |
| 3,841,481 | 10/1974 | Wehner | 209/310 |
| 4,064,051 | 12/1977 | Wehner | 209/310 X |
| 4,188,288 | 2/1980 | Wehner | 209/310 |
| 4,600,506 | 7/1986 | Hoppe | 209/310 |

FOREIGN PATENT DOCUMENTS

| | | | |
|---|---|---|---|
| 0208221 | 1/1987 | European Pat. Off. . | |
| 1206372 | 12/1965 | Fed. Rep. of Germany . | |
| 2158128 | 5/1973 | Fed. Rep. of Germany | 209/310 |
| 2209721 | 9/1973 | Fed. Rep. of Germany | 209/310 |
| 2333403 | 1/1975 | Fed. Rep. of Germany | 209/310 |
| 3214943 | 10/1983 | Fed. Rep. of Germany . | |
| 8816250 | 4/1989 | Fed. Rep. of Germany . | |

*Primary Examiner*—Michael S. Huppert
*Assistant Examiner*—Edward M. Wacyra
*Attorney, Agent, or Firm*—Toren, McGeady & Associates

[57] ABSTRACT

The invention concerns a screening apparatus comprising two frame systems which are movable relative to one another, comprising grate bars assigned to each system, which grate bars of each frame system are alternately disposed and are connected by means of flexible screen elements which are fastened at the latter, bridge the distance between the bars, and are tensioned and relieved of tension by means of the relative movement of the two systems caused by means of an eccentric shaft which is supported exclusively at the two systems and rotated by means of a drive. This known construction is improved, according to the invention, in that the eccentric shaft is arranged at one end of the two systems (1, 7) and the latter are connected with one another at a distance from this end by means of an element (12) which ensures a substantially linear relative movement of the two systems relative to one another. The aforementioned distance preferably corresponds to the distance of the acceleration pole ($P_B$) of the oscillating system (1, 7) from the eccentric shaft (3).

7 Claims, 2 Drawing Sheets

TWO FRAME ELASTIC SCREENING APPARTAUS HAVING SUBSTANTIALLY LINEAR RELATIVE MOVEMENT

BACKGROUND OF THE INVENTION

The invention is directed to a screening apparatus comprising at least two frame systems which are movable relative to one another, and grate bars assigned to each system. The grate bars engage in one another in pairs and are connected by means of flexible screen elements which are fastened at the latter, bridge the distance between the bars, and are tensioned and relieved of tension by means of the relative movement of the two systems caused by means of an eccentric shaft which is supported exclusively at the two systems and rotated by means of a drive.

Such a screening apparatus is described in the German Patent No. 1 206 372. In this reference, the eccentric shaft is arranged in the center of the screen length and the two systems are stabilized relative to one another by means of springs. However, this known apparatus does not meet expectations.

A vibrating screen is known from DE-A1 32 14943 in which a box, which contains at least one screen base and is flexibly supported at its ends, is connected in the area of one of its centers of oscillation with a vibration exciter. The exciter is a shaft arranged in the longitudinal center plane of the box and is provided with an unbalanced mass.

Accordingly, an irregular vibration field is created transversely as well as longitudinally, which causes an intensive loosening of the layer of material to be screened. However, this construction cannot be transferred to the screening apparatus mentioned in the beginning, in which two frames are provided which oscillate relative to one another and whose grate bars are connected with one another by means of flexible screen elements.

SUMMARY OF THE INVENTION

The invention has the object of providing a screening apparatus which is simple with respect to construction, inexpensive to operate and has a long service life. But, above all, it is to produce good screening outputs. This is achieved, according to the invention, in a screening apparatus of the type initially mentioned in that the eccentric shaft is arranged at one end of the two systems, and the latter are connected with one another at the other end or at a distance from this end by means of an element, such as guide rods, rubber thrust blocks, and the like, which ensures a substantially linear movement of the two systems relative to one another.

If the eccentric shaft is arranged at the end on the discharge side of the screened material, the systems initially execute circular oscillations by means of the guide rod or guide rod-like connection, which circular oscillations gradually adopt the shape of ellipses and, in the area of the guide rods, the shape of a flat circular arc or a straight line. The desired decrease in the oscillation effect is achieved in the constructional type according to the invention without additional effort. Accordingly, unnecessary drive energy is avoided, so that a higher output efficiency is achieved.

If the guide rods or the like are moved closer to the eccentric shaft, the frame systems again describe elliptical oscillations on the discharge side of the discharge of the screened material, which can be desirable with certain screening material.

It is particularly advantageous that the guide rods or the like be arranged in the area of the acceleration pole of the oscillation system. In most cases, the distance between the eccentric shaft and the guide rods, or the like, is approximately 60–80% of the screen length.

BRIEF DESCRIPTION OF THE DRAWINGS

The subject matter of the invention is shown in the drawing in an embodiment serving as an example.

DETAILED DESCRIPTION OF THE PREFERRED EMBODIMENTS

Figure 1:
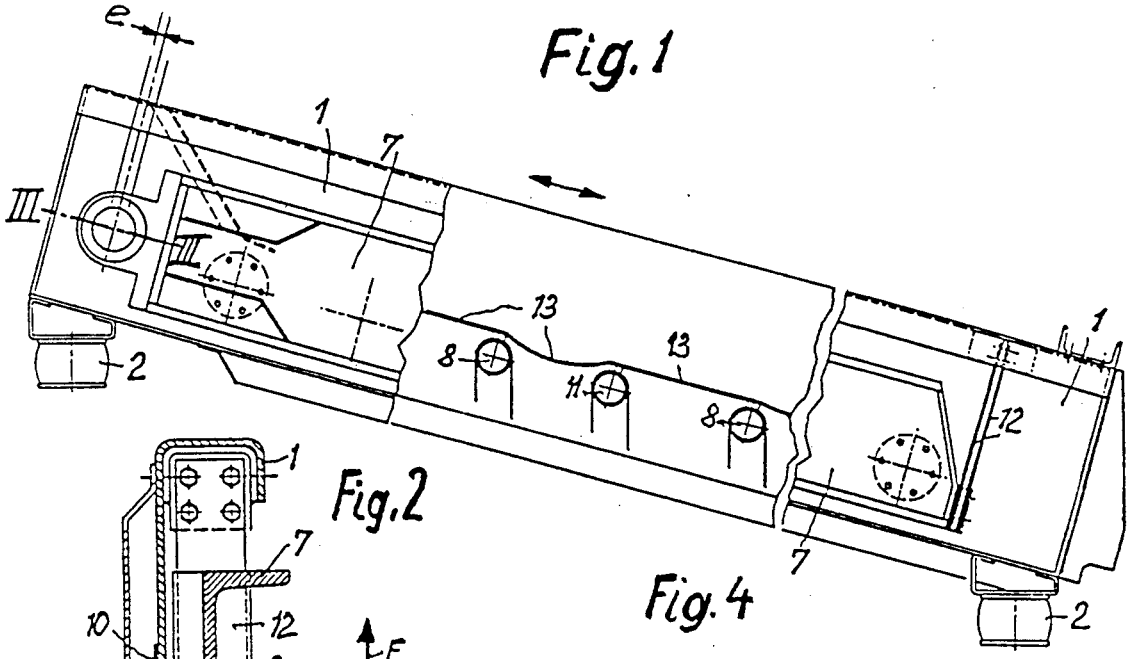
FIG. 1 shows the screening apparatus in a side view and partially in section.

The screening apparatus comprises a first frame system 1 which is supported at a foundation or machine frame, not shown, via spring elements 2. An eccentric shaft 3 is guided by means of the bearings 4 in the frame system 1 and its eccentric 5 in bearings 6 which are connected with the second frame system 7. According to FIG. 2, the frame system 7 is connected with grate bars 8 which penetrate an opening 9 in the frame system 1 and are screwed on at the web of the frame 7. The opening 9 is covered on the inside by means of a disk 10 which moves along with the system 7.

Figure 2:
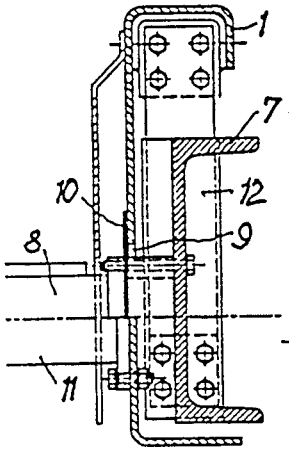
FIG. 2 shows in cross section the construction of the frame systems.

As follows from FIG. 2, the frame 1 is also screwed together with grate bars 11, wherein the grate bars 8 and 11 alternate.

The two systems 1 and 7 are connected with one another by means of spring guide rods 12 at the end on the discharge side of the screened material. The screen elements 13 between the grate bars 8 and 11 are alternately tensioned and relaxed by means of the oscillation of the two systems brought about by the eccentric shaft. The reciprocal relative movement in the longitudinal direction of the screen elements 13 amounts to $2e$, if e is the extent of the eccentricity of the shaft 3.

The extent of the oscillating movement of the system 1 can be favorably influenced in the area of the eccentric shaft by means of arranging a weight 14 on the eccentric shaft 3. Thus, for example, the system can be oscillated almost exclusively parallel to the screening surface, wherein the amplitude is sufficient for the self-cleaning of the system 1.

Figure 4:
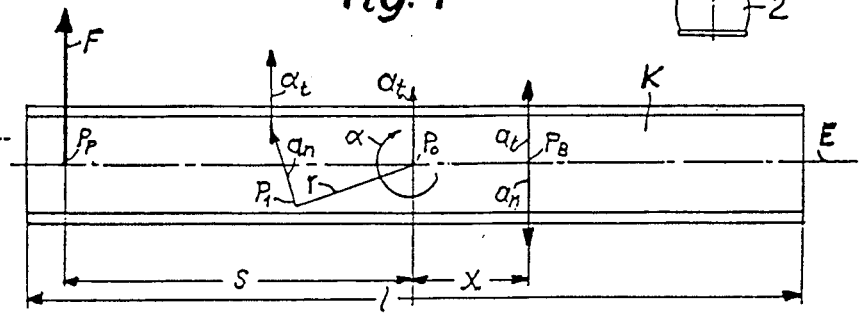
FIG. 4 shows a body at which a force acts eccentrically.
Figure 3:
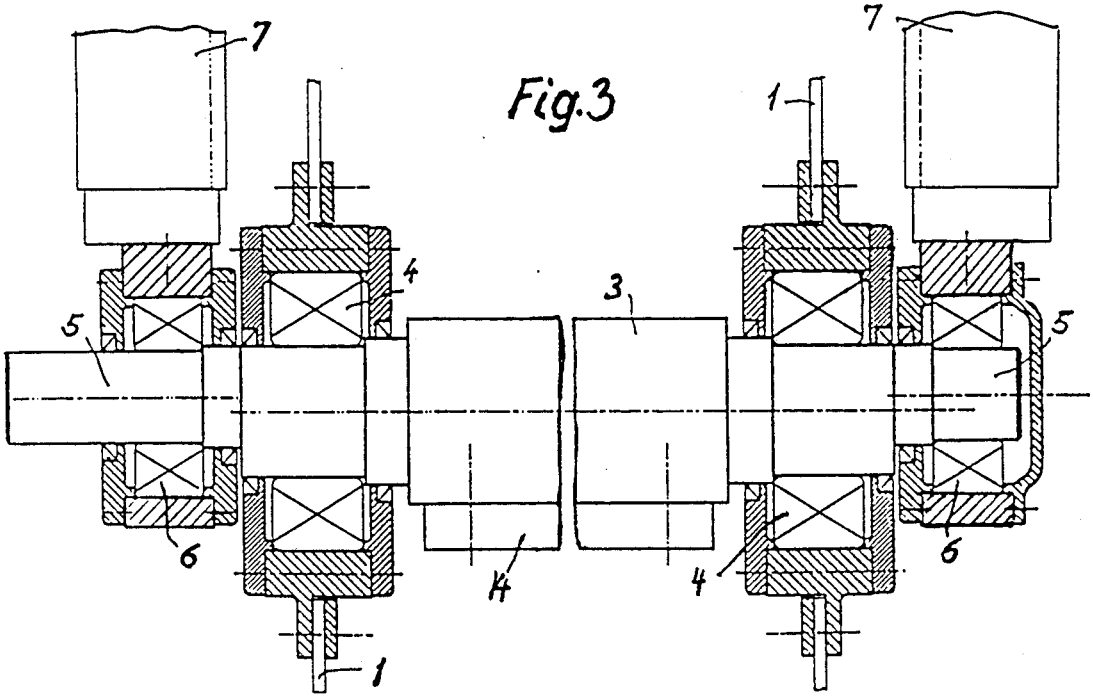
FIG. 3 shows a section, according to line III—III in FIG. 1.
Figure 5:
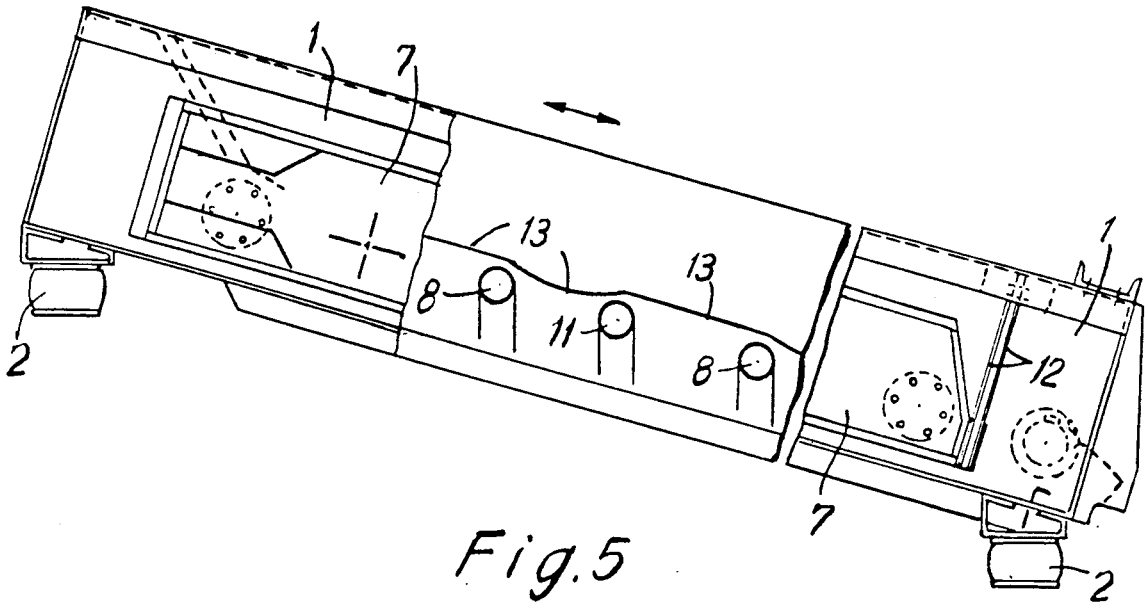
FIG. 5 shows a second embodiment.

The invention can also undergo an additional modification whose physical groundwork is explained by means of FIG. 4.

FIG. 4 shows a body K whose center of mass is $P_o$. The force F acts at this point $P_F$, so that a tangential acceleration $a_t$ is imparted to the body K and an angular acceleration $\alpha$ is produced around the center of mass $P_o$.

The following calculation results for the two accelerations in a given mass point $P_1$:

where r = the distance of the mass point $P_1$ from the center of mass $P_o$

M = the torque produced by the force F around the center of mass $P_o$ s = the distance of the force F from the center of mass $P_o$ $J_o$=the mass moment of inertia of the body K with reference to the center of mass $P_o$ m=the mass of the body K.

The tangential acceleration $a_t$ is of the same magnitude and directed in the same direction for all mass points of the body K.

The normal acceleration of the mass points increases with the distance from the center of mass $P_o$ and is perpendicular to the connecting line between the center of mass $P_o$ and the mass point. For the mass points which lie in a plane E, which is perpendicular to the force F and intersects the center of mass $P_o$, it is parallel to the tangential acceleration $a_t$. The normal acceleration is directed in the same direction to the left of the center of mass $P_o$ and is directed in the opposite direction of the tangential acceleration to the right of the center of mass $P_o$.

Therefore, there is a point in the plane E at which the tangential acceleration and the normal acceleration cancel one another. The acceleration pole $P_B$ lies at this point. Its distance from the center of mass $P_o$ is X:

$$\frac{F \cdot S}{J_o X} = \frac{F}{m}$$

$$X = \frac{J_o}{ms}$$

Given a stretched body with constant cross section and length l, then $$J_o = m\frac{l^2}{12}$$

If the distance of the force F from the center of mass $P_o$ is $$S = \frac{1}{2}, \text{ then}$$

$$X = \frac{1}{6}$$

If the guide rods 12 or the like are arranged in the area of the acceleration pole, restoring forces acting in a damping manner on the drive are eliminated, so that the required drive output is reduced. The system acts in an accelerating manner on the screened material from the discharge side of the screen to the acceleration pole. An increasing retardation of the screening material occurs from the acceleration pole to the end of the screen, so that there is a longer dwelling time on the screen for screening out borderline particles and there is accordingly an improved screening for this range of particle sizes.

The mass of the screening material located on the screen can also be taken into account in determining the acceleration pole, in that the screening material is included in the calculation of the mass moment of inertia around the common center of mass.

I claim:

1. Screening apparatus comprising two frame systems which are movable relative to one another, comprising grate bars assigned to each system, the grate bars of each frame system being alternately disposed and connected by means of flexible screen elements which are fastened at the latter, bridge the distance between the bars, and are tensioned and relieved of tension by means of the relative movement of the two systems caused by means of an eccentric shaft which is supported exclusively at the two systems and rotated by means of a drive, wherein the eccentric shaft (3) is arranged at one end of the two frame systems (1, 7), and further comprising means (12) for connecting the two frame systems with one another at a distance from the one end, so as to insure a substantially linear relative movement of the two systems relative to one another.

2. Screening apparatus according to claim 1, wherein said one end is a discharge end for screened material.

3. Screening apparatus according to claim 1 wherein the eccentric shaft (3) is equipped with a counterweight (14).

4. Screening apparatus according to claim 1, wherein the distance between the eccentric shaft (3) and the connecting means (12), which ensures a substantially linear relative movement of the two systems (1, 7) relative to one another, approximately corresponds to a distance of an acceleration pole ($P_B$) of the systems from the eccentric shaft.

5. Screening apparatus according to claim 4, wherein in the distance is 20%–40% smaller than the screen length.

6. A screening apparatus according to claim 1, wherein the connecting means includes guide rods which connect to the two frame systems.

7. A screening apparatus according to claim 1, wherein said connecting means includes rubber thrust blocks arranged so as to connect the two frame systems together.

* * * * *